US010039350B2

(12) United States Patent
Lo

(10) Patent No.: US 10,039,350 B2
(45) Date of Patent: Aug. 7, 2018

(54) STRAP BUCKLE STRUCTURE

(71) Applicant: Szu Chi Lo, Nantou (TW)

(72) Inventor: Szu Chi Lo, Nantou (TW)

( * ) Notice: Subject to any disclaimer, the term of this patent is extended or adjusted under 35 U.S.C. 154(b) by 283 days.

(21) Appl. No.: 15/151,992

(22) Filed: May 11, 2016

(65) Prior Publication Data

US 2017/0325549 A1 Nov. 16, 2017

(51) Int. Cl.
*A44B 11/22* (2006.01)

(52) U.S. Cl.
CPC ..... *A44B 11/22* (2013.01)

(58) Field of Classification Search
CPC ..... A44B 11/22; A44B 11/226; A44B 11/20; Y10T 24/1439; Y10T 24/4058; Y10T 24/44598; Y10T 24/45225
See application file for complete search history.

(56) References Cited

U.S. PATENT DOCUMENTS 3,883,928 A * 5/1975 Blake ..... A41F 9/002 24/163 R
5,074,012 A * 12/1991 Mitchell ..... B07B 1/46 24/514
6,357,093 B1 * 3/2002 Takahashi ..... A43C 3/00 24/712
2007/0084019 A1 * 4/2007 Wilcox ..... A43B 3/0078 24/3.1
2007/0180669 A1 * 8/2007 Apler ..... A43C 3/00 24/713.9
2015/0289609 A1 * 10/2015 Gittens ..... A44C 5/22 24/714.6

* cited by examiner

*Primary Examiner* — Robert Sandy
(74) *Attorney, Agent, or Firm* — Muncy, Geissler, Olds & Lowe, P.C.

(57) ABSTRACT

A strap buckle structure includes a strap body. Two ends of the strap body are provided with an upper buckle piece and a bottom buckle piece. The bottom buckle piece is provided with a raised seat having a threaded hole. The upper buckle piece has a through hole and positioning holes. The strap buckle structure further includes a bolt having a turning disc, a spring, an annular iron seat, and a sealing plate. The annular iron seat is provided with positioning buckles each having a one-way bevel. The positioning buckles are controlled to be inserted into or disengaged from the positioning holes of the upper buckle piece. The turning disc is turned by hand. The bolt is screwed to lock the upper and lower buckle pieces. By using a tool having a magnetic rod to turn the turning disc reversely, the upper and lower buckle pieces can be opened.

3 Claims, 3 Drawing Sheets

STRAP BUCKLE STRUCTURE

BACKGROUND OF THE INVENTION

1. Field of the Invention

The present invention relates to a strap buckle structure, and more particularly to a strap buckle structure which can be buckled quickly and prevent an accidental disengagement.

2. Description of the Prior Art

A signal transmission device, such as an electronic care tool, is provided with a wrist strap for a user to wear it on the wrist. The wrist strap is provided with a buckle to buckle two ends thereof. There are two types of strap buckles on the market. One is that the strap body has buckle holes at one end and a buckle stud at the other end. The buckle stud is inserted into one of the buckle holes so as to buckle the strap. The other is that one end of the strap body is provided with buckle holes and the other end of the strap body is provided with a raised seat. The raised seat has a threaded hole. The raised seat is inserted into one of the buckle holes, and then a bolt is locked to the threaded hole to provide a locking effect. The conventional strap buckles have the following shortcomings.

1. As to the former, it can be disassembled easily without a tool. Therefore, it may be opened illegally. As a result; the user cannot wear the strap.
2. As to the latter, although it is required to use a screwdriver to open the strap buckle, it is not difficult to get a screwdriver. Thus, the strap buckle can be opened easily.
3. As to the latter, it doesn't have a mechanism to prevent disengagement. The bolt may disengage from the strap buckle.

Accordingly, the inventor of the present invention has devoted himself based on his many years of practical experiences to solve these problems.

SUMMARY OF THE INVENTION

In view of this, the present invention is to overcome the shortcomings of the prior art. The primary object of the present invention is to provide a strap buckle structure. A strap buckle structure includes a strap body. Two ends of the strap body are provided with an upper buckle piece and a bottom buckle piece in cooperation with a bolt to be locked together. The upper buckle piece has a trough and positioning holes. The bolt has an integral a turning disc. The bottom surface of the turning disc is provided a spring, an annular iron seat, and a sealing plate. The annular iron seat is provided with positioning buckles each having a one-way bevel. The positioning buckles can be inserted into or disengaged from the positioning holes of the upper buckle piece. The user can turn the turning disc with his/her finger to drive the bolt to buckle the two ends of the strap body. The spring is adapted to prevent the bolt from loosening. Specially, it is necessary to use a tool having magnetism for unscrewing the bolt. This ensures that the strap body won't have an accidental disengagement.

DETAILED DESCRIPTION OF THE PREFERRED EMBODIMENTS

Figure 1:
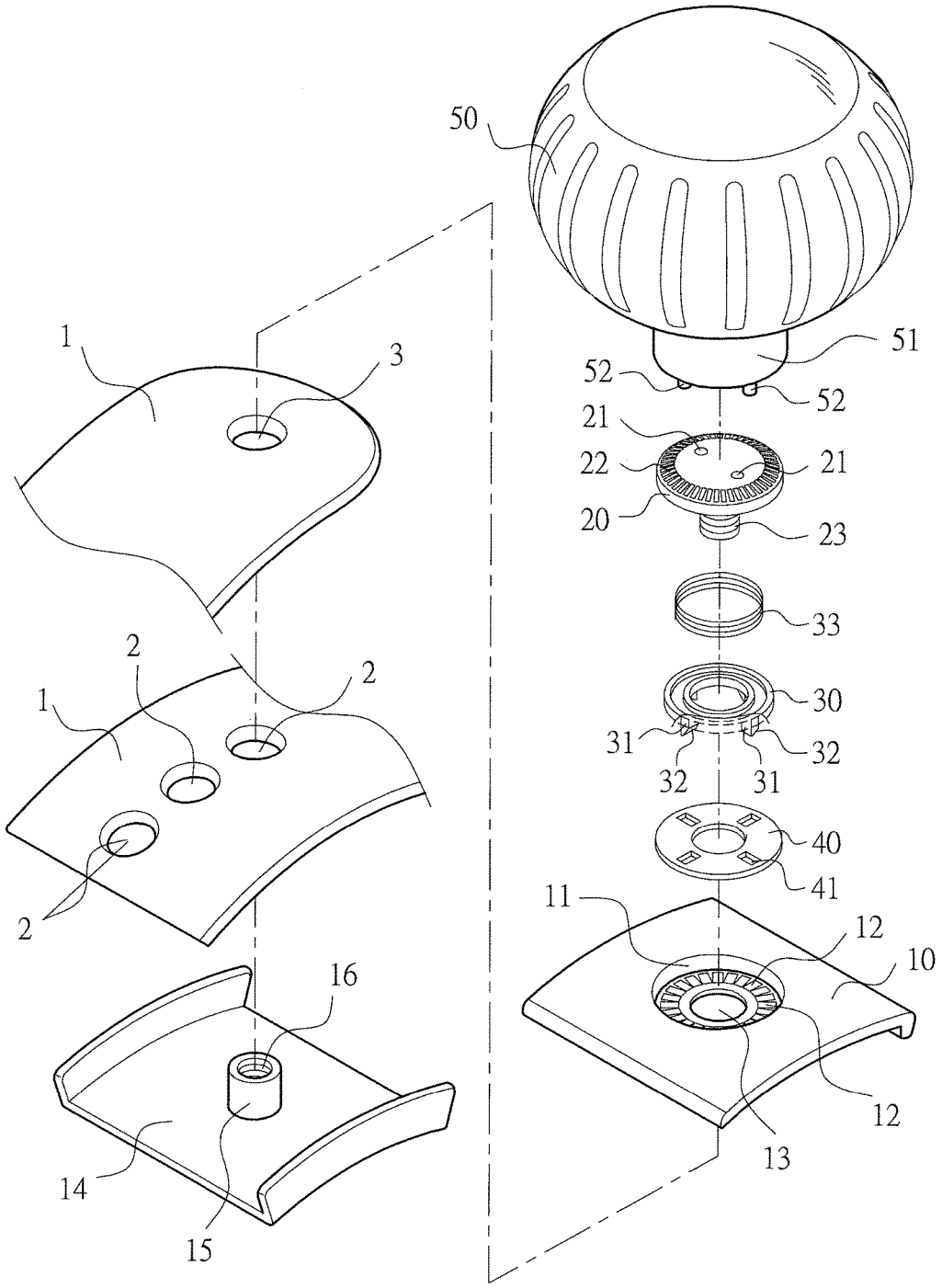
FIG. 1 is an exploded view of the present invention.

Embodiments of the present invention will now be described, by way of example only, with reference to the accompanying drawings.

As shown in FIG. 1, FIG. 2, FIG. 3 and FIG. 4, the present invention comprises a strap body 1 having buckle holes 2, 3 at two ends thereof. A bottom surface of the strap body 1 is provided with a bottom buckle piece 14. An upper surface of the strap body 1 is provided with an upper buckle piece 10. The bottom buckle piece 14 is provided with a raised seat 15 having a threaded hole 16. The upper buckle piece 10 has a through hole 13. The raised seat 15 passes through the buckle holes 2, 3 of the strap body 1 and the through hole 13 of the upper buckle piece 10. The upper buckle piece 10 further has a trough 11 and a plurality of positioning holes 12 at the bottom of the trough 11. The present invention further comprises a bolt 23 having a turning disc 20. The bolt 23 is screwed to the threaded hole 16 of the raised seat 15 of the bottom buckle piece 14. An upper end face of the turning disc 20 has a rough surface 22 and two recesses 21. A bottom surface of the turning disc 20 has an annular groove 24 to receive a spring 33 therein. An annular iron seat 30 is provided beneath the spring 33. A bottom surface of the annular iron seat 30 is provided with a plurality of positioning buckles 31. Each positioning buckle 31 has a one-way bevel 32. The present invention further comprises a sealing plate 40 to seal the annular iron seat 30 and the spring 33. The sealing plate 40 has a penetrating hole 41 for the positioning buckles 31 of the annular iron seat 30 to pass therethrough. The positioning buckles 31 are inserted to the positioning holes 12 of the upper buckle piece 10. The trough 11 of the upper buckle piece 10 is to accommodate the turning disc 20 of the bolt 23. A tool 50 is provided to unscrew the bolt 23 so as to open the two ends of the strap body 1. The tool 50 has a magnetic rod 51. A bottom end of the magnetic rod 51 has two protrusions 52 corresponding to the two recesses 21 of the turning disc 20 of the bolt 23. The protrusions 52 can be engaged with the recesses 21.

According to the aforesaid structure, the functions and effects of the present invention are described in detail as follows.

Figure 2:
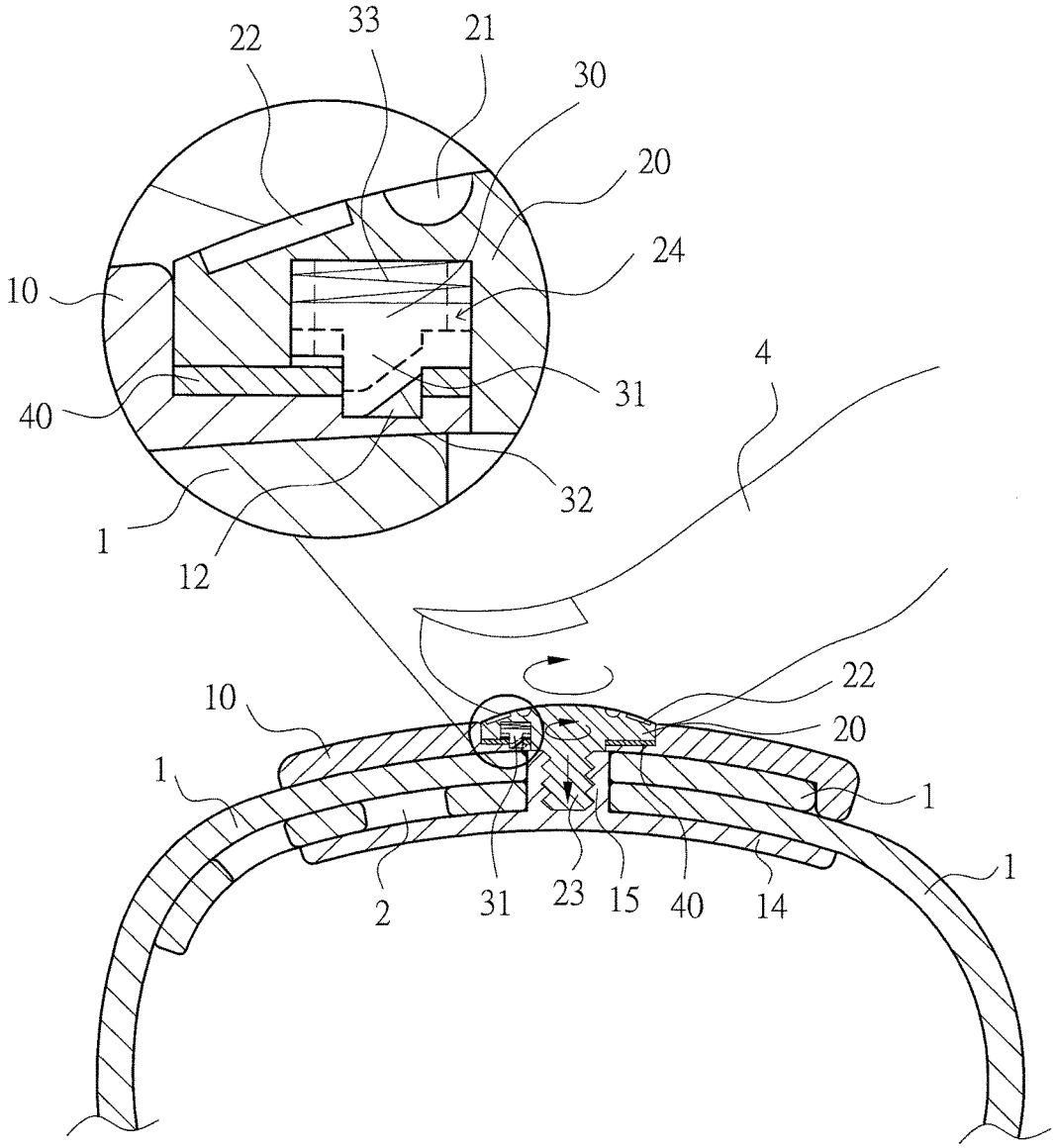
FIG. 2 is a sectional view of the present invention to be locked with a finger.

1. Locking and Buckling with a Finger:

As shown in FIG. 2, the turning disc 20 of the bolt 23 is turned with a finger 4. Because the upper end face of the turning disc 20 has the rough surface 22 to increase friction, the turning disc 20 can be turned. Besides, each positioning buckle 31 of the annular iron seat 30 is provided with the one-way bevel 32 to form a "one-way tooth" effect. The positioning buckles 31 are located above the positioning holes 12 of the upper buckle piece 10, not inserted into the positioning holes 12, such that the turning disc 20 and the bolt 23 can be turned for the bolt 23 to be screwed to threaded hole 16 of the raised seat 15 of the bottom buckle piece 14. That is to say, the two ends of the strap body 1 are buckled together. As the aforesaid, the present invention can be buckled with the finger 4. There is no need for a tool. It is convenient, easy and rapid for use.

Figure 3:
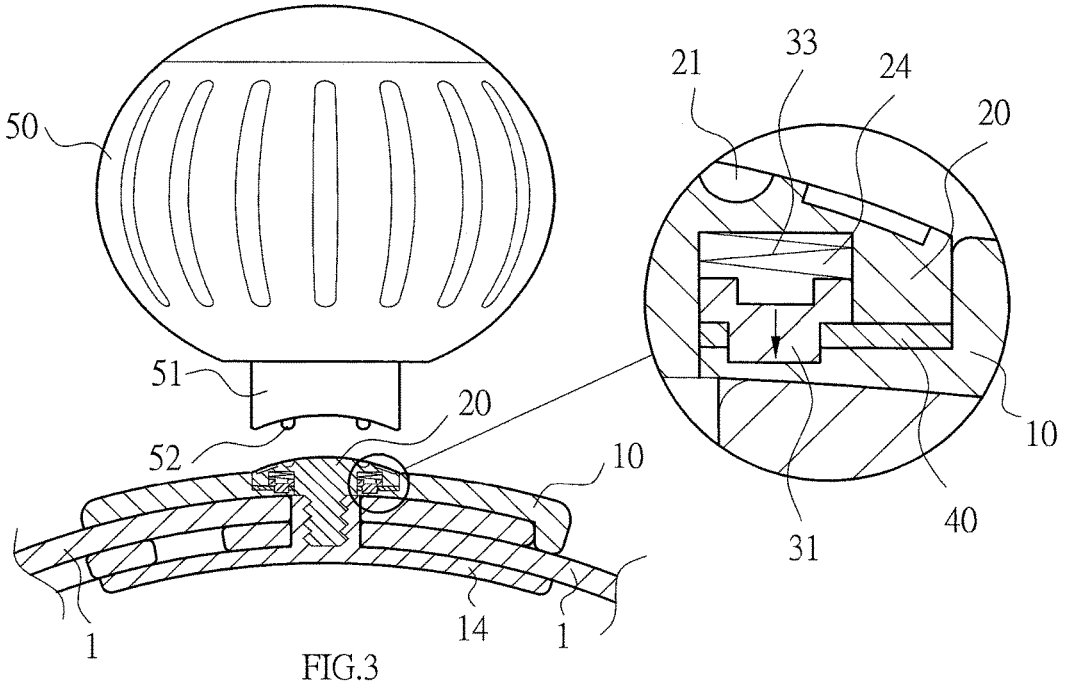
FIG. 3 is a sectional view of the present invention in a locked state.

2. Preventing Accidental Disengagement:

As shown in FIG. 3, after buckled, the positioning buckles 31 of the annular iron seat 30 are inserted into the positioning holes 12 of the upper buckle piece 10. If someone wants to unscrew the bolt 23 by the finger 4 or a common tool to turn the turning disc 20 reversely, the positioning buckles 31 cannot disengage from the positioning holes 12 because another side of each positioning buckle 31, opposite the one-way bevel 32, is to form a block "at a right angle". The bolt 23 cannot be unscrewed. Furthermore, the annular iron seat 30 is biased by the spring 33 to prevent the positioning buckles 31 from disengaging from the positioning holes 12, namely, this way can prevent the bolt 23 from loosening so as to avoid an accidental disengagement.

Figure 4:
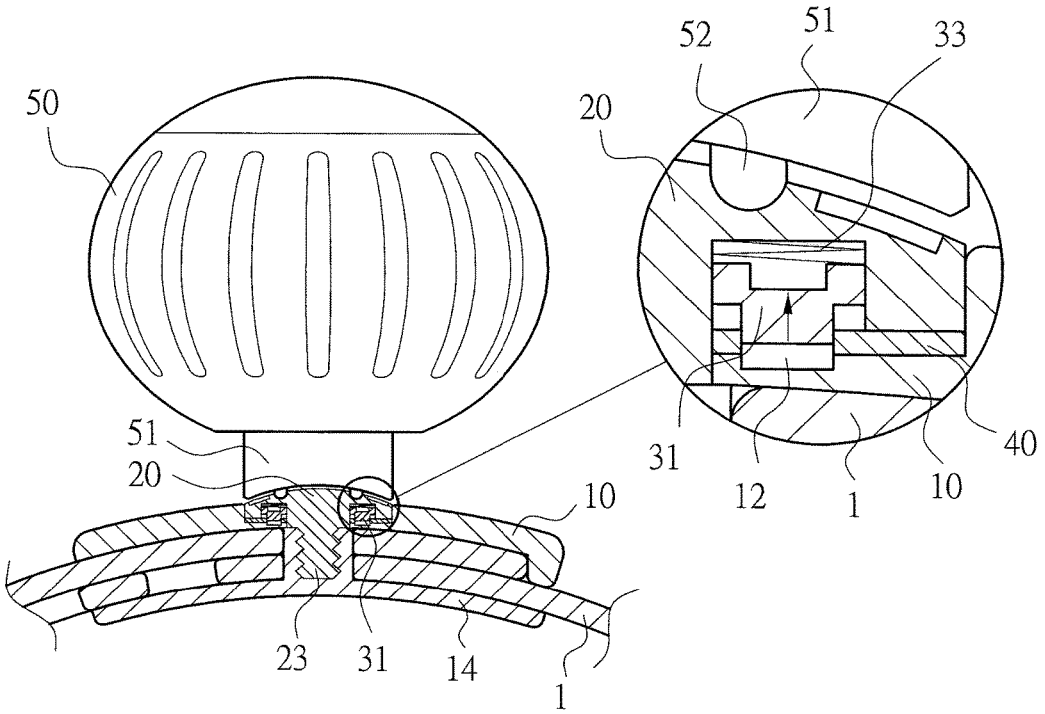
FIG. 4 is a schematic view of the present invention in an unlocked state.

3. Using a Special Tool 50 to Open the Strap Buckle:

As shown in FIG. 4, the tool 50 has the magnetic rod 51. The two protrusions 52 of the magnetic rod 51 are inserted into the two recesses 21 of the turning disc 20. The annular iron seat 30 is attracted by the magnetism of the magnetic rod 51, so the annular iron seat 30 with its positioning buckles 31 is moved upward and the positioning buckles 31 disengage from the positioning holes 12 of the upper buckle piece 10. Thus, the turning disc 20 with its bolt 23 can be turned, namely, the bolt 23 can be unscrewed to open the two ends of the strap body 1. From the above description, it is unable to unscrew the bolt 23 by using a common tool without magnetism. Therefore, the present invention can prevent an illegal opening.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A strap buckle structure, comprising a strap body having buckle holes at two ends thereof, a bottom surface of the strap body being provided with a bottom buckle piece, an upper surface of the strap body being provided with an upper buckle piece, the bottom buckle piece being provided with a raised seat having a threaded hole, the upper buckle piece having a through hole, the raised seat passing through the buckle holes of the strap body and the through hole of the upper buckle piece, the upper buckle piece further having a trough and a plurality of positioning holes at a bottom of the trough, a bolt having a turning disc being provided, the bolt being screwed to the threaded hole of the raised seat of the bottom buckle piece, a bottom surface of the tuning disc being provided with a spring, an annular iron seat being provided beneath the spring, a bottom surface of the annular iron seat being provided with a plurality of positioning buckles, each positioning buckle having a one-way bevel, a sealing plate being provided to seal the annular iron seat and the spring, the sealing plate having a penetrating hole for the positioning buckles of the annular iron seat to pass therethrough, the positioning buckles being inserted to the positioning holes of the upper buckle piece, the trough of the upper buckle piece being adapted to accommodate the turning disc of the bolt.

2. The strap buckle structure as claimed in claim 1, wherein an upper end face of the turning disc of the bolt has two recesses, a tool is provided for loosening the bolt, the tool has a magnetic rod, a bottom end of the magnetic rod has two protrusions corresponding to the two recesses of the turning disc of the bolt, when in use, the protrusions are engaged with the recesses, the annular iron seat is attracted by magnetism of the magnetic rod, the annular iron seat with the positioning buckles is moved upward and the positioning buckles disengage from the positioning holes of the upper buckle piece, the turning disc with the bolt can be turned to open the two ends of the strap body.

3. The strap buckle structure as claimed in claim 1, wherein an upper end face of the turning disc has a rough surface for a finger to touch and turn the turning disc.

* * * * *